US007845489B2

(12) United States Patent
Thompson

(10) Patent No.: US 7,845,489 B2
(45) Date of Patent: Dec. 7, 2010

(54) COMPARTMENTALIZED BEVERAGE CONTAINER DEVICE

(76) Inventor: Charles Thompson, 600 Valley Rd., Unit B-60, Warrington, PA (US) 18976

( * ) Notice: Subject to any disclaimer, the term of this patent is extended or adjusted under 35 U.S.C. 154(b) by 870 days.

(21) Appl. No.: 11/724,902

(22) Filed: Mar. 16, 2007

(65) Prior Publication Data

US 2008/0223739 A1 Sep. 18, 2008

(51) Int. Cl.
*A47G 19/22* (2006.01)

(52) U.S. Cl. ..... 206/217; 220/709; 220/713

(58) Field of Classification Search ..... 206/217, 206/218

See application file for complete search history.

(56) References Cited

U.S. PATENT DOCUMENTS

| | | | | |
|---|---|---|---|---|
| 2,328,872 | A * | 9/1943 | Yealdhall et al. | 206/217 |
| 2,766,796 | A * | 10/1956 | Tupper | 220/521 |
| 5,673,789 | A * | 10/1997 | Degraff-Eugene | 206/217 |
| 5,996,781 | A * | 12/1999 | Glaser et al. | 206/217 |
| 6,299,014 | B1 * | 10/2001 | Nava et al. | 220/521 |
| 6,533,233 | B2 * | 3/2003 | Thomas | 248/311.2 |
| 6,766,902 | B1 * | 7/2004 | Hartelius | 206/217 |
| 6,817,951 | B2 * | 11/2004 | Levine | 472/57 |
| 7,217,434 | B1 * | 5/2007 | Loh et al. | 426/115 |

* cited by examiner

*Primary Examiner*—Jacob K Ackun, Jr.
(74) *Attorney, Agent, or Firm*—Armand M. Vozzo, Jr.

(57) ABSTRACT

An improved compartmentalized beverage container device is disclosed including a cup member having an open chamber with a handle attached thereto, a lid cover formed having a dome-like surface and a rim adapted to engage the top of the open chamber of the cup member together with a lid insert adapted to engage the rim of the lid cover beneath the dome-like surface to provide a first storage compartment above the cup member, and a base chamber integrally formed beneath the cup member with an access opening in the bottom thereof to provide a second storage compartment below the cup member. The lid cover is further formed having a hole and separate slot made through the dome-like surface and the lid insert provided with a convex surface made to be directed toward the dome-like surface with a tubular member further extending from the insert to engage the hole in the surface of the cover. Both storage compartments provide accessible chambers for carrying personal items, the first compartment for coins and coin-like souvenirs and the second compartment for rally towels and the like, without disturbing beverage contained within the cup or interfering with its consumption.

17 Claims, 4 Drawing Sheets

FIG. 9
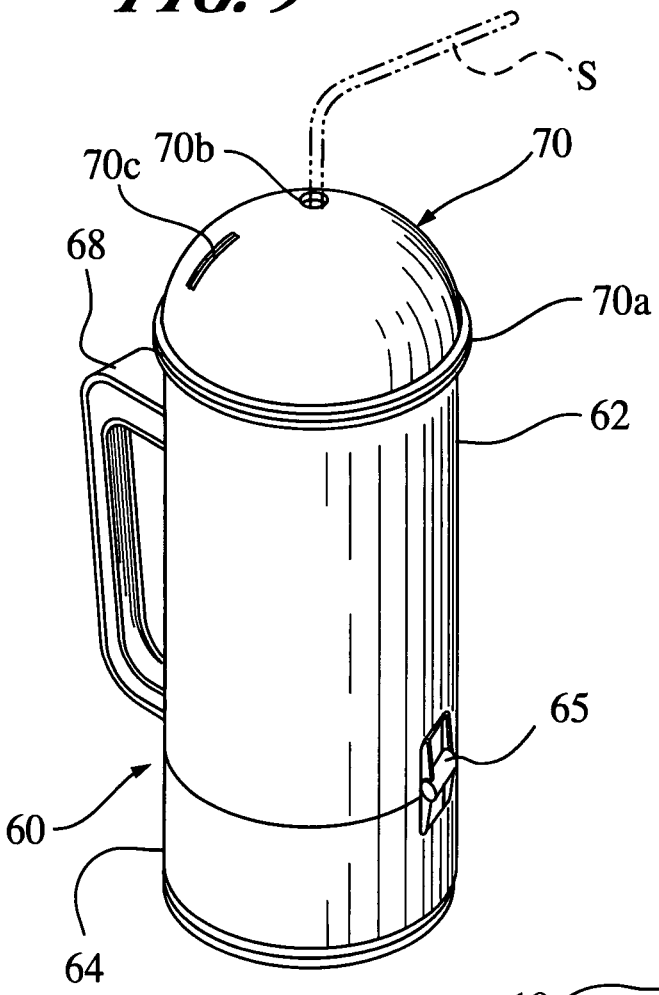
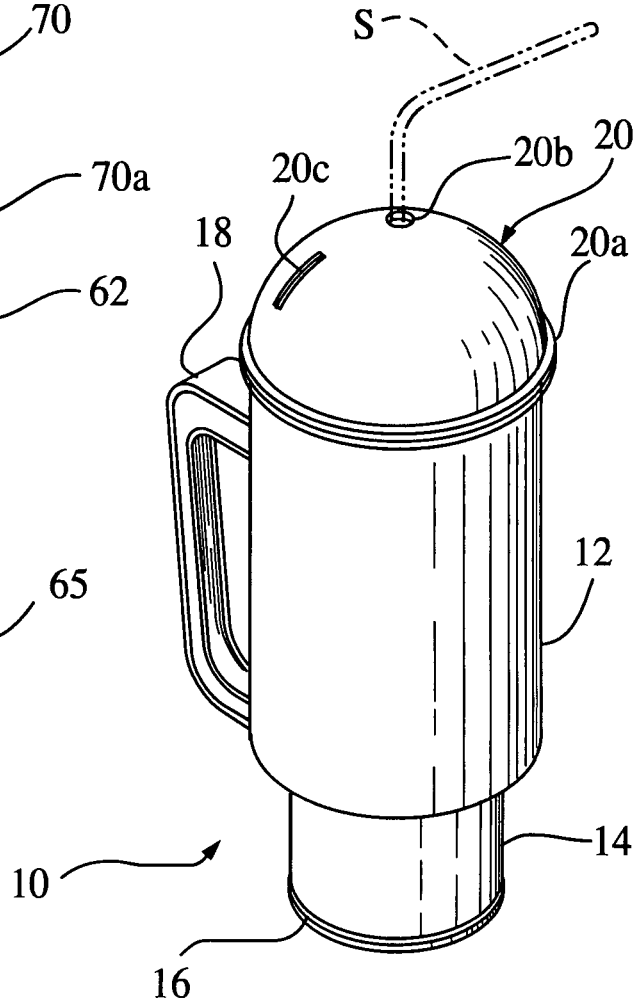
FIG. 1

FIG. 2
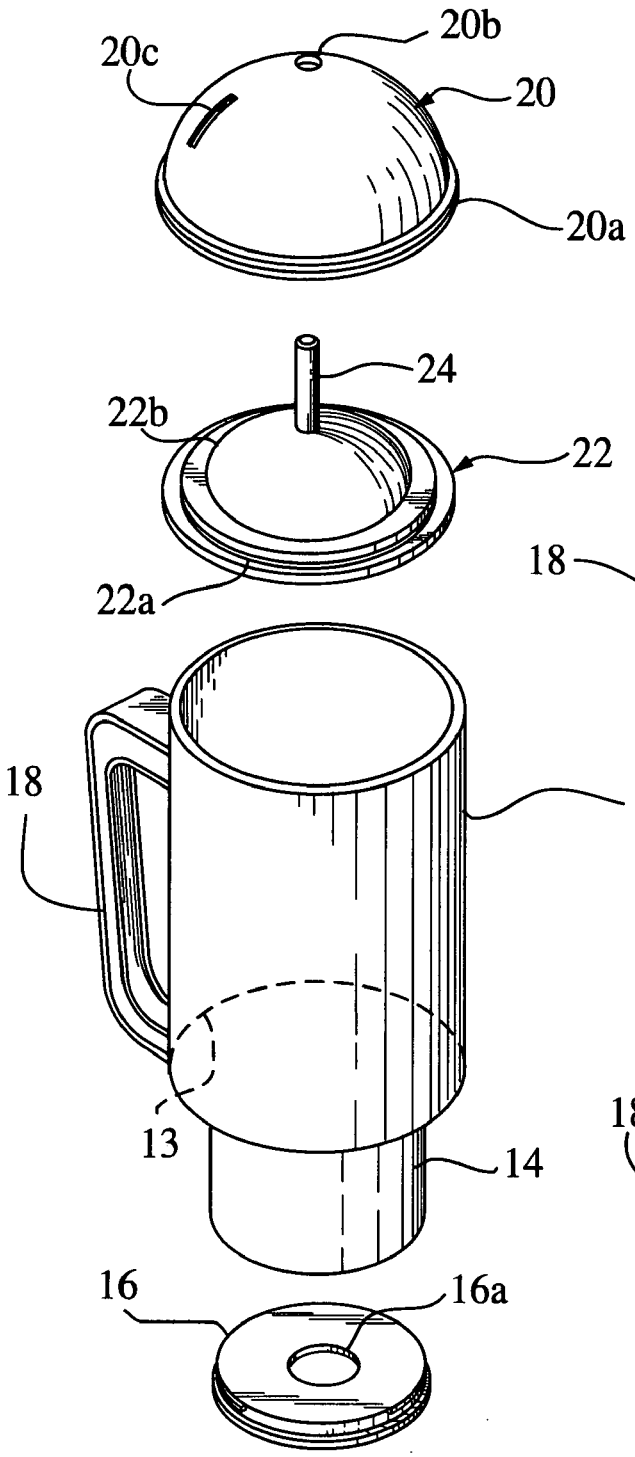
FIG. 3
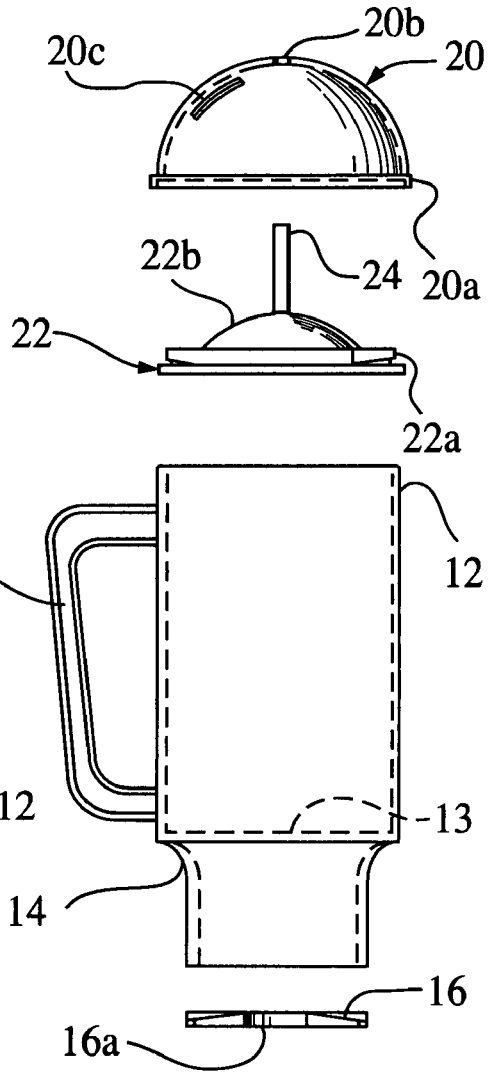
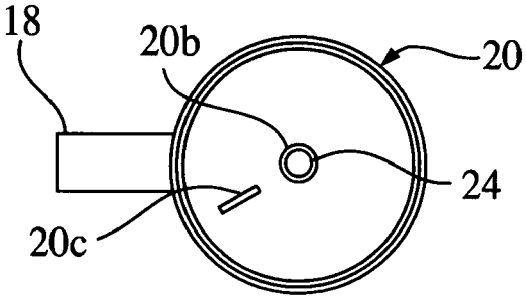
FIG. 4

FIG. 5
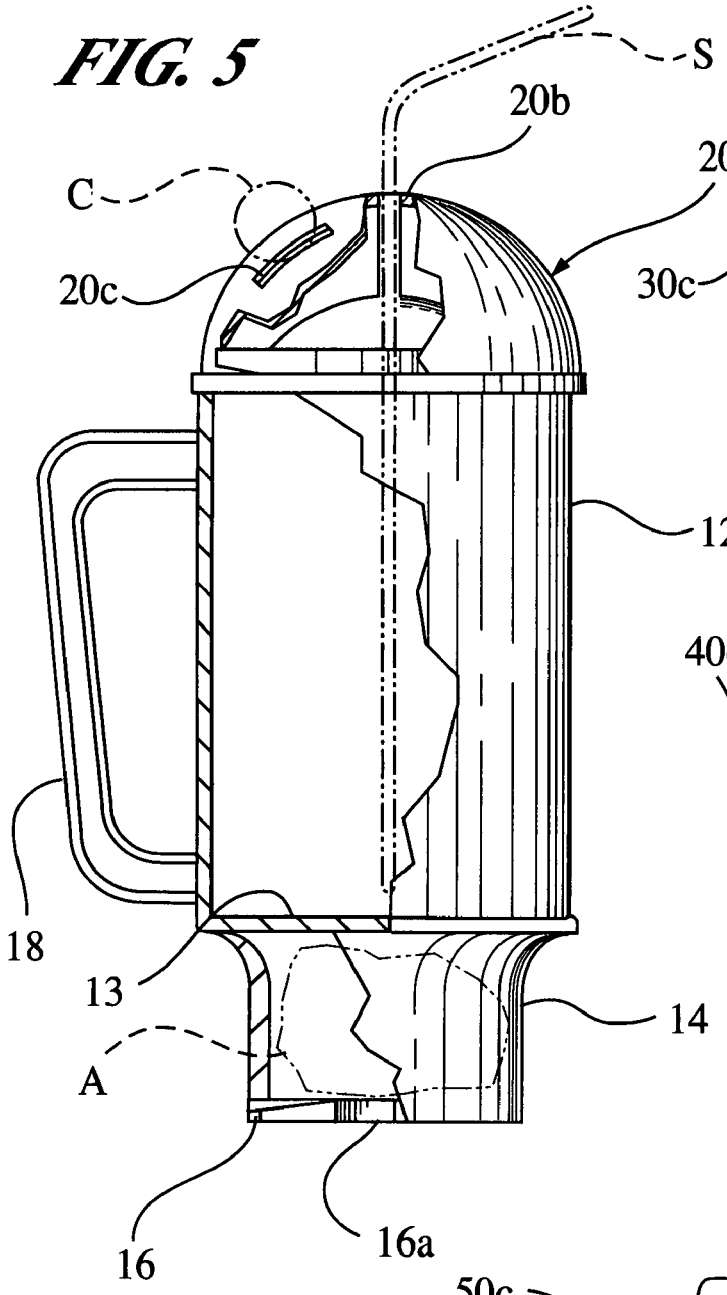
FIG. 6
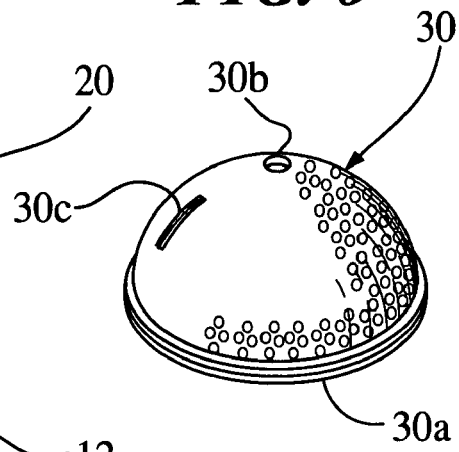
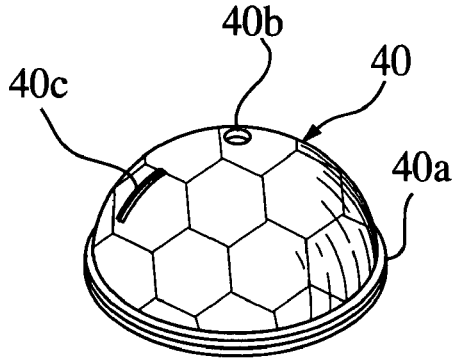
FIG. 7
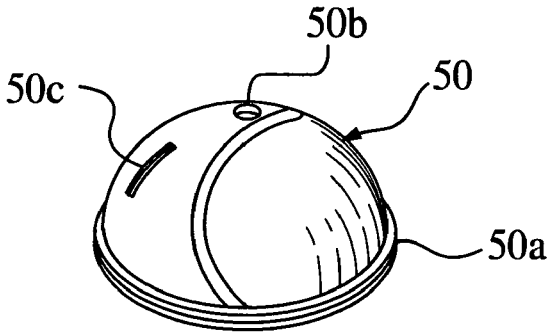
FIG. 8

FIG. 10
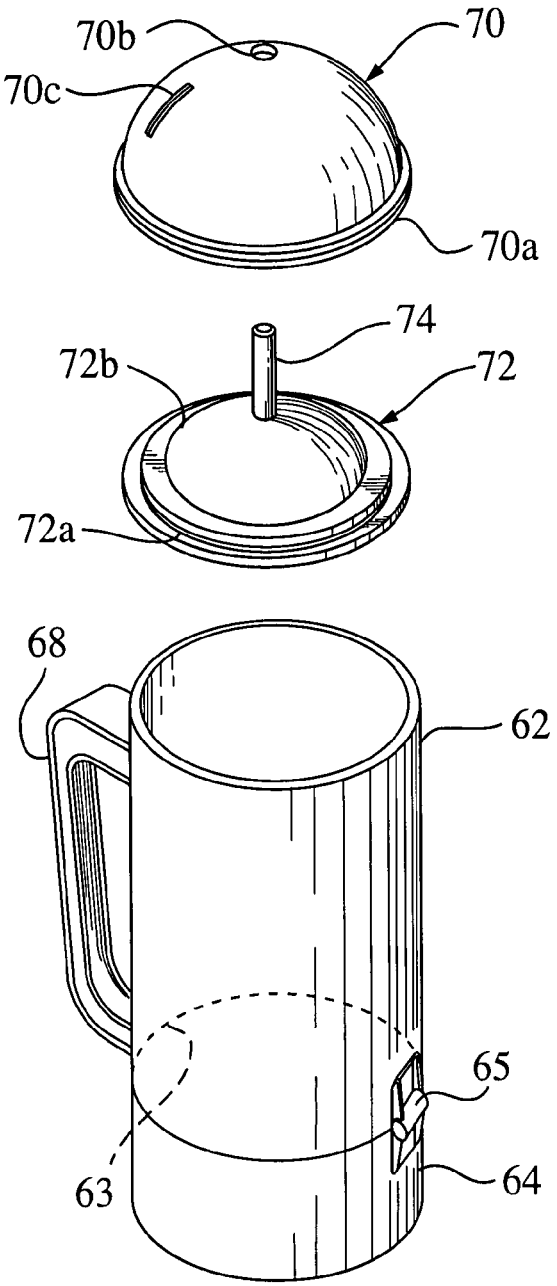
FIG. 11
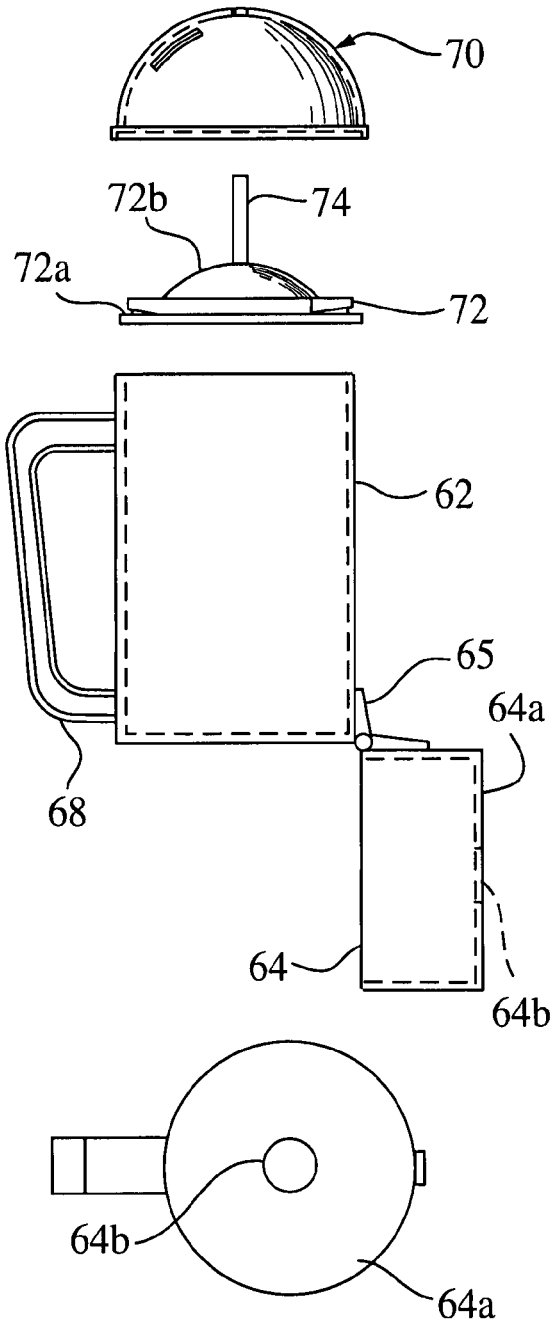
FIG. 12

COMPARTMENTALIZED BEVERAGE CONTAINER DEVICE

BACKGROUND OF THE INVENTION

The present invention relates to beverage containers of the type generally used by consumers for drinking, and more particularly to an improved multi-purpose beverage container device having separate accessible compartments formed above and below a main cup chamber to permit storage of articles and their access without disturbing the beverage contained within the cup chamber and interfering with its consumption.

Beverages sold to consumers at sporting and entertainment events as well as at amusement parks and other public gatherings are typically provided and served in standard cups of various sizes with lids that are formed to cover the top of the cup while providing some access to the beverage within for its for consumption. In many cases, the consumers at these events and gatherings are engaged in different activities and transactions, receiving coins and other forms of currency, as well as being involved in collecting small souvenirs and other articles associated with the event or gathering. Many, if not all, of these items received in hand need to be temporarily stored and retained in some way during the course of the event and for sometime thereafter. It would therefore be desirable for consumers and venders as well at these public events to have the beverages sold and served for consumption in a drinking container having one or more compartments formed together therewith so that any important items or articles collected by the consumer can be easily retained and stored within the container without disturbing the beverage contents and the normal consumption thereof.

There have been various types and forms of beverage containers that have been devised and developed with additional functional capabilities beyond that of liquid containment. Several of these multi-functional beverage containers found in the prior art have been designed having one or more receptacles, cavities or other receiving chambers formed within their structure in addition to the primary liquid-holding chamber to receive, carry and/or store one or more items of a personal nature often found in the possession of the consumer, such as a cigarette lighter, a comb, a pager or a cellular phone. Examples of such prior art beverage containers found to provide additional storage chambers for personal items include U.S. Pat. No. 4,795,028 to Wittig et al.; U.S. Pat. No. 5,531,353 to Ward et al.; U.S. Pat. No. 6,092,647 to Yeh et al.; and U.S. Pat. Nos. D514,896 and D516,393 both to Wickenhauser. While these and other prior art devices and designs for multi-functional beverage containers have been satisfactory in storing various personal items in their separate chambers, none have been found particularly effective in both receiving and carrying both with ease and convenience the many coins and like forms of souvenir items that are often gathered by consumers while they attend public events and consume their beverage of choice. Furthermore, none of the devices or designs for multi-chambered beverage containers found in the prior art allow for both the storage of and easy access to towel-like articles commonly referred to by sports fans as "rally towels" that are deployed and waved by fans while cheering during the course of a sporting event.

SUMMARY OF THE INVENTION

Accordingly, it is a general purpose and object of the present invention to provide an improved multi-functional beverage container device capable of storing personal items of a consumer without interfering with the consumption of the beverage contents therein.

A more particular object of the present invention is to provide an improved beverage container for use by a consumer at sporting and entertainment events and other public gatherings with added storage capabilities for coins and like forms of souvenir items that may be collected and carried without disturbing the ability to drink from the container.

Another object of the present invention is to provide a multifunctional beverage container device equipped with improved means within the container structure to store and carry personal items without adversely affecting beverage consumption.

Still another object of the present invention is to provide an improved beverage container for fans at sporting events that is capable of conveniently storing and easily accessing rally towels or the like used for cheering purposes.

A further object of the present invention is to provide a multi-functional beverage container device that is relatively inexpensive to manufacture, easy to handle and use, and capable of repeated use without adversely affecting any of its multiple functions.

Briefly, these and other objects of the present invention are accomplished by an improved compartmentalized beverage container device comprising a cup member having an open chamber with a handle attached thereto, a lid cover formed having a dome-like surface and a rim adapted to engage the top of the open chamber of the cup member together with a lid insert adapted to engage the rim of the lid cover beneath the dome-like surface to provide a first storage compartment above the cup member, and a base chamber formed beneath the cup member with an access opening in the bottom thereof to provide a second storage compartment under the cup member. The lid cover is further formed having a hole and separate slot made through the dome-like surface and the lid insert provided with a convex surface directed toward the dome-like surface of the cover with a tubular member further extending from the insert to engage the hole in the surface of the cover. Both storage compartments provide accessible chambers for carrying personal items, the first compartment for coins and coin-like souvenirs and the second compartment for rally towels and the like, without disturbing beverage contained within the cup or interfering with its consumption. In an alternate embodiment of the container device, the base chamber is formed with a separate member hingedly connected to the cup member.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which:

FIG. 1 is a perspective view of one embodiment of a beverage container device according to the present invention;

FIG. 2 is an exploded perspective view of the beverage container device shown in FIG. 1;

FIG. 3 is an exploded plan view in elevation of the beverage container device shown in FIG. 1;

FIG. 4 is a top plan view of the beverage container device shown in n FIG. 1;

FIG. 5 is an elevational view of the beverage container device of FIG. 1 with selected portion cut away;

FIG. 6 is a perspective view of a separate cover for the present beverage container device having a surface configuration in the form of a golf ball;

FIG. 7 is a perspective view of a separate cover for the present beverage container device having a surface configuration in the form of a soccer ball;

FIG. 8 is a perspective view of a separate cover for the present beverage container device having a surface configuration in the form of a basketball ball;

FIG. 9 is a perspective view of a second embodiment of a beverage container device according to the present invention;

FIG. 10 is an exploded perspective view of the beverage container device shown in FIG. 9;

FIG. 11 is an exploded plan view in elevation of the beverage container device shown in FIG. 9; and FIG. 12 is a bottom plan view of the beverage container device of FIG. 9.

DETAILED DESCRIPTION OF THE INVENTION

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to the appended claims.

Referring now to FIG. 1, a preferred embodiment of the present beverage container device, generally designated 10, is shown with a flexible straw S (in phantom outline) projecting from the top of the device. In accordance with the present invention, the beverage container device 10 comprises a cup member 12 with a substantially cylindrical chamber formed within its perimeter wall and open at the top to accept and hold a liquid beverage for consumption that, in the case of the assembled device, would be facilitated using the straw S in its typical fashion. The cup member 12 is further formed having a substantially flat bottom surface 13, better shown in FIGS. 2 and 3, that is transversely disposed at the base of the perimeter wall to close and seal the bottom of the cup chamber. A gripping handle 18 shown having a C-shaped configuration is secured along the outer wall of the cup member 12 and may be integrally formed therewith or made separately and attached to the outer wall. Handle 18 may alternatively have an open configuration that still allows gripping of cup member 12.

Immediately beneath the bottom surface 13 of cup member 12, a separate base chamber 14 is disposed having its perimeter wall formed about the same central axis as that of the cup member. The base chamber 14 is cylindrical in its perimeter configuration similarly to the cup member 12 and preferably has the same or slightly lesser diameter as that of the perimeter wall of the cup member. Other perimeter configurations of the base chamber 16 may include multi-sided linear forms, such as that of a pentagon, hexagon or octagon. The base chamber 14 preferably has an open bottom with the length or extension of the base chamber wall being a predetermined dimension but generally less than that of the cup member 12. A base cover 16 formed having the same perimeter configuration as the base chamber 14 is adapted to fit and fasten to the open bottom of the base chamber, the outer edge of the base cover being formed to releasably engage the open bottom either though a snap fit or threaded engagement. The base cover 16 is further provided with a central opening 16*a*, as better shown in FIG. 2, to permit access to the base chamber when the cover is in place and facilitate its release.

The present beverage container device 10 further includes a dome-shaped lid cover 20 assembled and releasably connected to the cup member 12 above the open top of its chamber. The lid cover 20 is formed having a substantially hemispherical surface with a major diameter that is substantially the same as that of cup member 12. A connecting rim 20*a* formed about the bottom edge of the lid cover 20 is adapted to fit over and engage upon the open top of the cup member 12, preferably being secured with a snap fitting engagement. Upon and through the dome-shaped surface of the lid cover 20, a pair of separate openings are made in the form of a hole 20*b* that is substantially circular in configuration and centrally located at the top of the cover and a slot 20*c* that is substantially rectangular in configuration and located along the arc of the dome-shaped surface between the hole at the top of the cover and the rim 20*a*. The hole 20*b* is intended and sized to fit the tubular diameter of the straw S and the slot 20*c*, as more specifically described below, is made to accept coins and coin-shaped items in various sizes. A lid insert 22, better viewed and described in greater detail below in reference to FIGS. 2 and 3, is assembled beneath the lid cover 20 and made to be disposed immediately upon the open top of the cup member 12 to form an independent storage compartment for coins and coin-like souvenirs in the present beverage container device 10.

Referring now to FIGS. 2-4 in conjunction with FIG. 1, the lid insert 22 is a specially configured member circular in form having a substantially flat perimeter rim disposed around the bottom of the insert, a raised lip 22*a* formed around the insert immediately above the perimeter rim and positioned inside the outer diameter thereof, a convex surface layer 22*b* formed above the raised lip and across the middle portion of the insert, and a tubular member 24 secured upon the convex surface layer and made to project radially from the top thereof. The perimeter rim of the lid insert 22 has an outer diameter substantially the same as that of the top of cup member 12 and is further made to fit closely inside the connecting rim 20*a* formed about the bottom edge of the lid cover 20. The raised lip 22*a* of lid insert 22 is formed and adapted to engage the interior of the connecting rim 20*a* of lid cover 20, preferably by a snap fitting or thread-like engagement that serves to assemble the insert to the cover and fasten them together. The convex surface layer 22*b* projects above the raised lip 22*a* of the lid insert 22 and radially toward the dome-shaped surface of the lid cover 20 when the insert and cover are assembled together, whereupon the convex surface layer provides an arched up bottom surface to the chamber of the compartment formed above the cup member 12 in the present beverage container device 10. The arched up bottom surface provided by the convex surface layer 22*b* allows coins and coin-like souvenirs, when placed within the compartment chamber of the assembled lid cover 20 and insert 22, to be dispersed smoothly within the chamber compartment and further facilitates the engagement of the lid insert upon the top of the cup member 12, particularly when filled with an iced beverage, the raised curvature of the convex surface layer providing a spatial volume beneath the lid insert and above the cup member assembled thereto that allows ice floating at the top of the beverage to gather and collect without forcing the ice or the beverage from the top of the cup member.

The tubular member 24 provided on the lid insert 22 is formed having an outer diameter sized to fit and engage the hole 20*b* in the dome-shaped cover 20 and further made of sufficient length to extend into the hole when the lid insert is assembled to the lid cover. The length of the tubular member 24 is preferably such as to provide a flush fit with the top surface of the lid cover 20. The inner diameter of the tubular member 24 is sized to coaxially fit the straw S that is intended for use with the beverage container device 10 and further allow the straw to be held within the chamber of the tubular member without binding or restricting the straw.

All of the comprised elements of the present beverage container device 10, particularly the cup member 12 and its handle 18, the base chamber 14 and associated base cover 16, and the lid cover 20 and lid insert 22 together with the tubular member 24, are made from a lightweight but relatively strong and durable material, such as a plastic, that may be molded and fabricated, as necessary, to form the respective elements either separately or in an integral form, using conventional manufacturing tooling and processing.

Referring now to FIG. 5, the present beverage container device 10 is shown in its assembled state with separate storage compartments formed above and below the main chamber of cup member 12 wherein beverage is intended to be contained for drinking consumption. Above the main chamber of cup member 12, the lid insert 22 is assembled and connected to the lid cover 20 with the raised lip 22*a* of the insert being engaged about the connecting rim 20*a* of the cover and the tubular member 24 engaged within hole 20*b* of the cover thereby forming the upper chamber compartment within the present beverage container device 10. The connected assembly of lid cover 20 and lid insert 22 is together secured upon the open top of the cup member 12 through engagement of the connecting rim 20*a* on the cover. With the lid cover 20 and insert 22 assembled and secured in this position, the perimeter rim of the insert is disposed immediately upon the top of cup member 12 in abutting contact therewith thereby substantially covering the open top of the cup member and closing the main chamber except for the vent provided by the tubular member 24 through the convex surface layer 22*b*. Straw S may be then fed through the tubular member 24 in order to draw beverage from the main chamber of the cup member 12 and while doing so, coins C or coin-like souvenir (shown in phantom outline) may be inserted through the rectangular slot 20*c* of the lid cover 20 to be dispersed upon the convex surface layer 22*b* and stored within the upper compartment chamber sealed from the beverage and without interfering with the flow of the beverage through the straw.

Below the main chamber of cup member 12, the base chamber 14 extends beneath the bottom surface 13 of the cup member with its perimeter walls projecting from the cup member in a similar form and coaxial manner. With base cover 16 engaged and fastened to the open bottom of the base chamber 14, a personal article A (shown in phantom outline) or attendant item associated with a particular event, such as the "rally towel" used at various sporting events, may be easily stored and accessed via the opening 16*a* in the base cover.

Referring now to FIGS. 6-8, some alternative surface configurations of the smooth, dome-shaped lid cover 20 of the present beverage container device 10 are depicted in the form of objects used in associated sports competitions. In FIG. 6, a lid cover 30 provided with a connecting rim 30*a*, similar in structure to rim 20*a* of lid cover 20, is further formed having the dome-shaped surface thereof configured with dimple-like markings about the surface (only partially depicted) so as to appear like a golf ball with a circular hole 30*b* and rectangular slot 30*c* made therethrough. In FIG. 7, a lid cover 40 having a connecting rim 40*a*, similar in structure to rim 20*a* of lid cover 20, is further formed having its dome-shaped surface made with a circular hole 40*b* and rectangular slot 40*c* made therethrough and configured with linear markings in pentagonal shapes about the surface so as to appear like a soccer ball. In FIG. 8, lid cover 50 having a connecting rim 50*a*, similar in structure to rim 20*a* of lid cover 20, is formed with a circular hole 50*b* and rectangular slot 50*c* made through its dome-shaped surface, in this case configured with curved markings about the surface so as to appear like a basketball. It should be noted and understood that further surface configurations having the appearance of other sports objects, such as a baseball or tennis ball, may be made on the dome-shaped lid cover of the disclosed beverage container device within the scope of the present invention.

Referring now to FIGS. 9-12, a second preferred embodiment of the present beverage container device, generally designated 60, is shown with a flexible straw S (in phantom outline) projecting from the top of the device in FIG. 9. The beverage container device 60 of the present invention, like that of the container device 10, comprises a cup member 62, made similar to cup member 20, having an open top and flat bottom surface 63 together with a handle 68, similar in configuration to handle 18, connected along the outer wall of the cup member. A dome-shaped lid cover 70, made similar to the lid cover 20 described above, is likewise formed with a circular connecting rim 70*a* at the base together with a circular hole 70*b* and rectangular slot 70*c* made through the dome-shaped surface. Like lid cover 20, the lid cover 70 of the beverage container device 60 is formed to releasably engage the top of the cup member 62 and adapted to connect therewith about its corresponding connecting rim 70*a* together with a lid insert 72, made similar to insert 22 in form and structure, assembled beneath the lid cover.

As best viewed in FIGS. 10 and 11, the lid insert 72 is a specially configured member circular in form having a substantially flat perimeter rim disposed around the bottom of the insert, a raised lip 72*a* formed around the insert immediately above the perimeter rim and positioned inside the outer diameter thereof, a convex surface layer 72*b* formed above the raised lip and across the middle portion of the insert with a tubular member 74 secured upon the convex surface layer and made to project radially from the top thereof. Like those corresponding elements of the beverage container device 10 described above in detail, the lid insert 72 is connected and assembled to the lid cover 70 via releasable engagement of its raised lip 72*a* with the connecting rim 70*a* of the lid cover and the fitted engagement of the top of tubular member 74 with the circular hole 70*b* of the cover to thereby form the upper chamber compartment within the present beverage container device 60.

Beneath the main chamber of cup member 62, a lower storage compartment is formed in beverage container device 60 by a base cup 64 having a substantially cylindrical perimeter wall and a flat bottom surface 64*a* with a central opening 64*b* made therein. The base cup 64 is formed having the same outer diameter as cup member 62 and is intended to be coaxially disposed immediately beneath and abutting the bottom surface 63 of the cup member. The base cup 64 is pivotally connected to the cup member 62 using a hinge member 65 of conventional design that is positioned between the top of the base cup and the bottom of the cup member and attached to their respective perimeter walls. The hinge member 65 is preferably of the type that is spring-loaded in its deflection, such as with a torsion spring, so that the hinge member may be biased toward the "closed" position, as seen in FIG. 10, and able to be returned thereto from the "open" position, as seen in FIG. 11. To ensure closure with the bottom of cup member 62 when desired, the top edge of the base cup 64 opposite from the hinge member 65 may be formed with a raised tab or like projection capable of friction engagement with the abutting edge of the cup member. The separate compartment thus provided in the beverage container device 60 beneath the cup member 62 by the base cup 64 and associated hinge member 65 allows the convenient storage and ready access of personal items and/or articles particularly associated with an event.

Therefore, it is apparent that the described invention provides an improved multi-functional beverage container device capable of storing personal items of a consumer without interfering with the consumption of the beverage contents therein. More particularly, the described beverage container device provides an improved drinking container for use by a consumer at sporting and entertainment events and other public gatherings with added storage capabilities for coins and like forms of souvenir items that may be collected and carried without disturbing the ability to drink from the container. Incorporated into the structure of a beverage container, the present invention provides separate storage compartments, particularly useful to attendees at sporting and entertainment events, for coins and collectables that are frequently gathered by the attendees. The present invention, as described above, further provides an improved beverage container for fans at sporting events that is capable of conveniently storing and easily accessing rally towels or the like used for cheering purposes. In addition, the described invention provides a multi-functional beverage container device that is relatively inexpensive to manufacture, easy to handle and use, and capable of repeated use without adversely affecting any of its multiple functions.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. For example, the lid insert 22 may be reconfigured in the curvature of its convex surface layer 22*b* and either reduced or increased in its radius to alternately increase or reduce the size of the upper storage chamber formed in assembly with the lid cover 20. Furthermore, the tubular member 24 may be alternately secured and made to project radially from the convex surface layer 22*b* in different angular directions relative to the substantially vertical direction shown in the drawing figures, and in such cases, the hole 20*b* in the lid cover 20 would be adjusted in its position to properly engage the top of the tubular member as intended and described above. Accordingly, it is understood that this invention is not limited to the particular embodiment described, but rather is intended to cover modifications within the spirit and scope of the present invention as expressed in the appended claims.

What is claimed is:

1. A beverage container device for use with a straw to consume a beverage, comprising:

a cup member formed having a chamber open at the top and a closed bottom surface for holding the beverage therein;

cover means assembled and releasably connected to said cup member for forming a first storage compartment above said cup member sealed from the chamber thereof, said cover means comprising:

a lid cover formed having a dome-shaped surface and a rim around the base thereof, the dome-shaped surface further having separate openings therethrough in the respective forms of a hole and slot;

a lid insert member adapted to engage the rim around the dome-shaped surface of said lid cover to form a compartment chamber therewith, said lid insert member being formed having a curved transverse surface with a perimeter rim adapted to cover the top of said cup member and a raised lip disposed about the perimeter rim adapted to engage the rim around said lid cover, said curved transverse surface of said lid insert member having an opening made therethrough; and a tubular member fitted to hold the straw and connected between the opening in the curved transverse surface of said lid insert member and the hole in the dome-shaped surface of said lid cover, said tubular member being formed and fitted into flush engagement with the hole in the dome-shaped surface of said lid cover to seal the first storage compartment from the chamber of said cup member; and base chamber means disposed beneath said cup means for forming a second storage compartment separate from the chamber of said cup member.

2. A beverage container device according to claim 1, further comprising:

a handle operatively connected to said cup member.

3. A beverage container device according to claim 1, wherein the curved transverse surface of said lid insert member comprises:

a convex surface raised within the perimeter rim with the opening made therethrough.

4. A beverage container device according to claim 3, wherein the hole through the dome-shaped surface of said lid cover is substantially circular in configuration and centrally located at the top thereof.

5. A beverage container device according to claim 4, wherein the slot through the dome-shaped surface of said lid cover is substantially rectangular in configuration and located along the arc of the dome-shaped surface between the hole at the top and the rim at the base.

6. A beverage container device according to claim 5, wherein the dome-shaped surface of said lid cover is configured to appear as a ball-type object used in sports competition.

7. A beverage container device according to claim 2, wherein said base chamber means comprises:

a base chamber member integrally formed beneath the bottom surface of said cup member and extending therefrom in a substantially cylindrical configuration having an open bottom; and a base cover formed to fit and adapted to releasably engage the open bottom of said base chamber member, said base cover having an opening therethrough to provide access to the interior of said base chamber member.

8. A beverage container device according to claim 2, wherein said base chamber means comprises:

a base chamber member pivotally connected to said cup member beneath the bottom surface thereof and formed with an access opening therein.

9. A beverage container device according to claim 8, wherein said base chamber means further comprises:

a hinge member operatively connected between said base chamber member and said cup member.

10. A beverage container device used with a straw to consume a beverage, comprising:

a cup member having an open chamber for holding a beverage therein;

dome-shaped cover means assembled and adapted to engage said cup member for forming a storage compartment above said cup member sealed from the open chamber, said dome-shaped cover means comprising:

a lid cover formed having a dome-shaped surface and a rim around the base thereof, the dome-shaped surface further having separate openings therethrough in the respective forms of a hole and a slot;

a lid insert member adapted to engage the rim around the dome-shaped surface of said lid cover to form a compartment chamber therewith, said lid insert member being formed having a curved transverse surface with a perimeter rim adapted to cover the top of said cup member and a raised lip disposed about the perimeter rim adapted to engage the rim around said lid cover, said curved transverse surface of said lid insert member having an opening made therethrough; and a tubular member fitted to hold the straw and connected between the opening in the curved transverse surface of said lid insert member and the hole in the dome-shaped surface of said lid cover, said tubular member being formed and fitted into flush engagement with the hole in the dome-shaped surface of said lid cover to seal the first storage compartment from the chamber of said cup member; and a base chamber member connected to said cup member for forming a storage compartment below said cup member separated from the open chamber.

11. A beverage container device according to claim 10, wherein the hole through the dome-shaped surface of said lid cover is substantially circular in configuration and centrally located at the top thereof.

12. A beverage container device according to claim 11, wherein the slot through the dome-shaped surface of said lid cover is substantially rectangular in configuration and located along the arc of the dome-shaped surface between the hole at the top and the rim at the base.

13. A beverage container device according to claim 12, wherein the dome-shaped surface of said lid cover is configured to appear as a ball-type object used in sports competition.

14. A beverage container device according to claim 10, wherein the curved transverse surface of said lid insert member comprises:

a convex surface raised within the perimeter rim with the opening made therethrough.

15. A beverage container device according to claim 10, wherein base chamber member is integrally formed beneath said cup member with perimeter walls extending therefrom in the same configuration as said cup member and a bottom wall having an access opening to the storage compartment formed thereby.

16. A beverage container device according to claim 10, wherein base chamber member is pivotally coupled to said cup member and formed with an access opening therein.

17. A beverage container device according to claim 16, wherein said base chamber member is pivotally coupled to said cup member by a hinge.

* * * * *